US007097081B2

(12) United States Patent
Frassinelli

(10) Patent No.: US 7,097,081 B2
(45) Date of Patent: Aug. 29, 2006

(54) COAT HANGER STRUCTURE WITH VARIABLE WIDTH

(75) Inventor: Ernesto Frassinelli, Vittorio Veneto (IT)

(73) Assignee: BENCOM S.r.l., (IT)

( * ) Notice: Subject to any disclaimer, the term of this patent is extended or adjusted under 35 U.S.C. 154(b) by 199 days.

(21) Appl. No.: 10/730,894

(22) Filed: Dec. 10, 2003

(65) Prior Publication Data

US 2004/0129743 A1 Jul. 8, 2004

(30) Foreign Application Priority Data

Dec. 10, 2002 (IT) ..... BG2002A0043

(51) Int. Cl.
*A41D 27/22* (2006.01)

(52) U.S. Cl. ..... 223/89; 223/94

(58) Field of Classification Search ..... 223/85, 223/88, 89, 94

See application file for complete search history.

(56) References Cited

U.S. PATENT DOCUMENTS

| | | | | |
|---|---|---|---|---|
| 5,044,535 | A * | 9/1991 | Hunt | 223/95 |
| 5,456,391 | A * | 10/1995 | Chang | 223/94 |
| 5,598,957 | A * | 2/1997 | Bell | 223/94 |
| 5,718,358 | A * | 2/1998 | Long et al. | 223/94 |
| 5,941,429 | A * | 8/1999 | Koons | 223/94 |
| 5,975,385 | A * | 11/1999 | See | 223/94 |
| 6,068,166 | A * | 5/2000 | Kilian et al. | 223/94 |
| 6,173,871 | B1 * | 1/2001 | Woodworth | 223/94 |
| 6,409,058 | B1 * | 6/2002 | Lam et al. | 223/94 |
| 6,722,538 | B1 * | 4/2004 | Autry et al. | 223/94 |

FOREIGN PATENT DOCUMENTS

| | | |
|---|---|---|
| DE | 297 10 306 U | 8/1997 |
| DE | 200 08 718 U1 | 9/2000 |
| FR | 636 467 A | 4/1928 |
| GB | 2 262 224 | 6/1993 |

OTHER PUBLICATIONS

European Search Report in corresponding European Patent Application EP 03 07 8823 dated Apr. 6, 2004.

* cited by examiner

*Primary Examiner*—Gary L. Welch
(74) *Attorney, Agent, or Firm*—Connolly Bove Lodge & Hutz LLP

(57) ABSTRACT

Adjustable clothes hanger structure (10, 40) comprising an upper hanging hook (12, 42) fixed to its centre point (14, 44), two symmetrical side arms (16,16'; 46,46') extending from said centre point (14, 44) and movable means (18,18'; 48,48'; 58,58') for supporting the garment fixed integrally with sliding elements (22,22'; 52,52') in cavities (20,20'; 50,50') provided inside said arms (16,16'; 46,46'). The means of support can be fitted above the arms (16, 16') for optimal support of sleeve units, or below the arms (46, 46') for optimal support of garments such as skirts or trousers. The structure permits adjustment of the means of support (18,18'; 48,48'; 58,58') of the garment to the required width, so that the clothes hanger can be adapted to different garment sizes.

10 Claims, 6 Drawing Sheets

COAT HANGER STRUCTURE WITH VARIABLE WIDTH

The present invention concerns a clothes hanger structure with adjustable width.

Basically two types of clothes hanger exist. The first type, suitable for sleeve units, i.e. jackets, coats and similar, is provided typically with curved arms shaped roughly like the shoulders of a person, so that the sleeve unit rests on the upper part of said arms substantially in the same way as it is worn by the user. The second type, suitable for trousers, skirts and similar, is provided typically with clips that open at the bottom to accommodate the garment, which is suspended from them and hangs taut due to the effect of gravity. A variation of this second type of clothes hanger is provided with a horizontal bar, with or without clips, on which the garment is folded.

Naturally garments have very different dimensions according to the age and size of the end user. Said variability means that it is necessary either to have clothes hangers in different sizes or use a small clothes hanger also for large-size garments. In both cases the disadvantages arising from said situation are obvious.

Adjustable clothes hangers have been proposed and exist on the market, particularly of the type for skirts and trousers, in which the garment supporting clips can slide on the outside of a horizontal bar along its whole length, thus permitting reciprocal positioning at the required distance. This solution, apart from the fact that it is not applicable in the case of clothes hangers for sleeve units, has the disadvantage of leaving the user to find the minimum working distance between the clips, since the structure described allows them to slide along the entire bar until they are adjacent or reach a position of contact, not useful for supporting the garment.

The present invention aims to overcome the disadvantages of the known clothes hangers, providing a clothes hanger structure with variable width capable of permitting standardisation of the product in the manufacturing phase and at the same time supporting the garment perfectly both during transport and industrial or domestic storage.

The above aim is achieved by means of an adjustable clothes hanger structure, comprising upper hanging means, two symmetrical side arms that extend from the centre point of said structure and movable means of support for the garment, characterised in that said movable means of support are fixed integrally to elements sliding in cavities provided inside said arms, thus permitting width adjustment of said movable means of support for the garment.

The present invention will now be described with reference to the attached drawings, provided as a non-restrictive example, in which.

Figure 1:
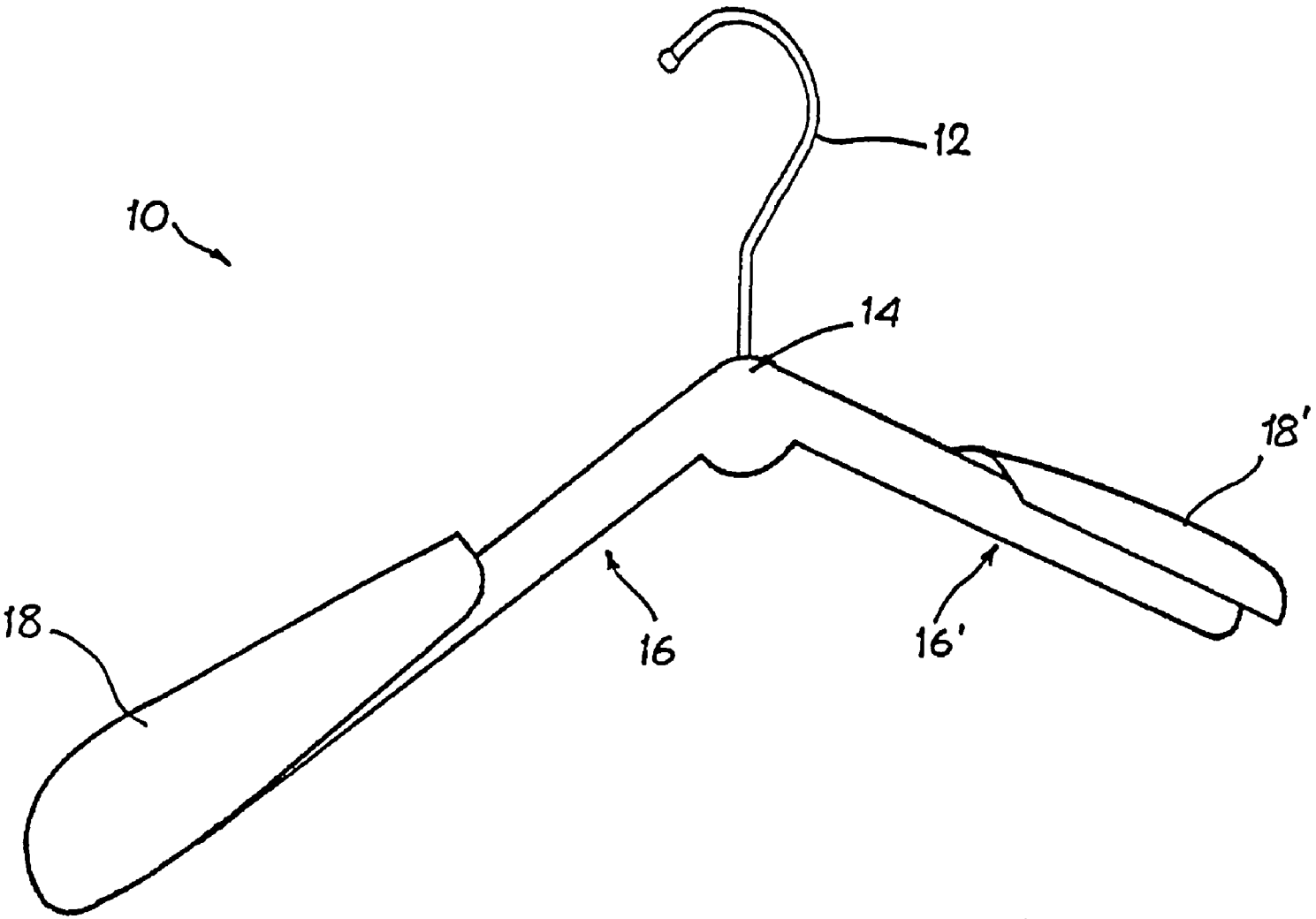
FIG. 1 is a perspective view of a clothes hanger structure according to a first embodiment of the invention.

As shown in FIG. 1, a first embodiment of the invention consists in a clothes hanger structure 10 provided with upper hanging means, typically consisting of a hook 12 fixed to the centre point 14 of the structure itself. The structure also comprises two symmetrical arms 16, 16', extending laterally from the centre point 14 and slanting downwards. In their distal part, each arm 16, 16' is provided with movable support elements 18, 18' for the garment which, according to said first embodiment of the invention, is typically a sleeve unit. The supporting elements 18, 18' have a curved shape roughly similar to a person's shoulders, for appropriate positioning of the garment.

Figure 2:
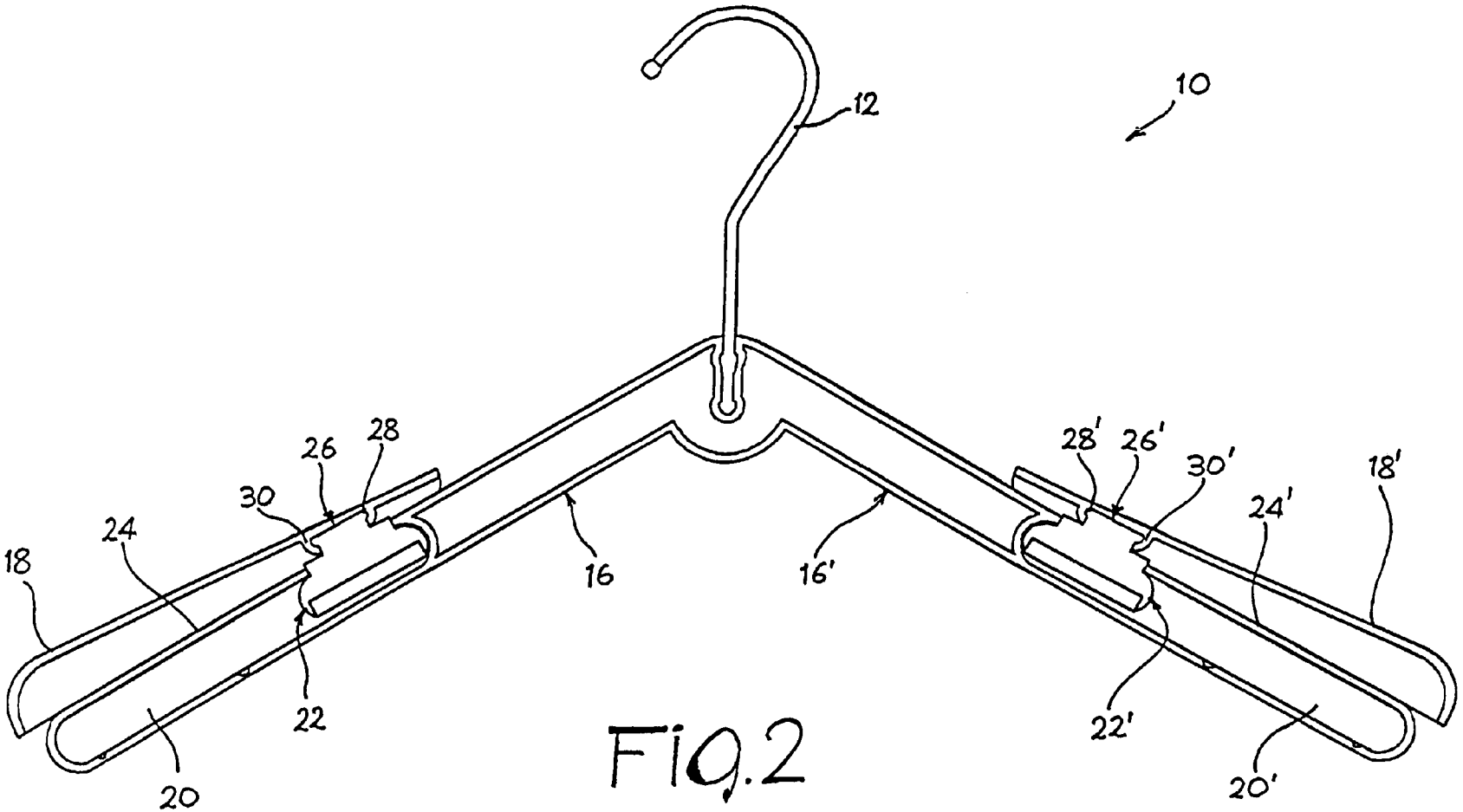
FIG. 2 is a longitudinal section view of the clothes hanger structure according to FIG. 1.

As illustrated in FIG. 2, elongated cavities 20, 20' are provided in the arms 18, 18' extending from the end of the arms to a roughly intermediate area of each arm. Said cavities 20, 20' constitute the seats of sliding fixing elements 22, 22', which slide like shuttles in contact with the walls of the cavities 20, 20', therefore being capable of maintaining any intermediate or extreme position inside the cavities. In the upper part of the arms 16, 16' longitudinal apertures 24,24' are provided through which projections 26,26' of the shuttles 22, 22' emerge. Such projections 26, 26' are provided with protruding edges 28, 28' that constitute fixing and supporting elements for the supporting means 18, 18' by engaging in corresponding seats 30, 30' provided in the lower part of the supporting means 18, 18. It is obvious that by moving the latter in a direction parallel to the arms 16, 16', the shuttles 22, 22' will slide in their respective cavities, with the possibility of choosing a more or less extended position of the support elements 18, 18' of the garment, therefore adjusting the width of the clothes hanger as required.

Figure 3:
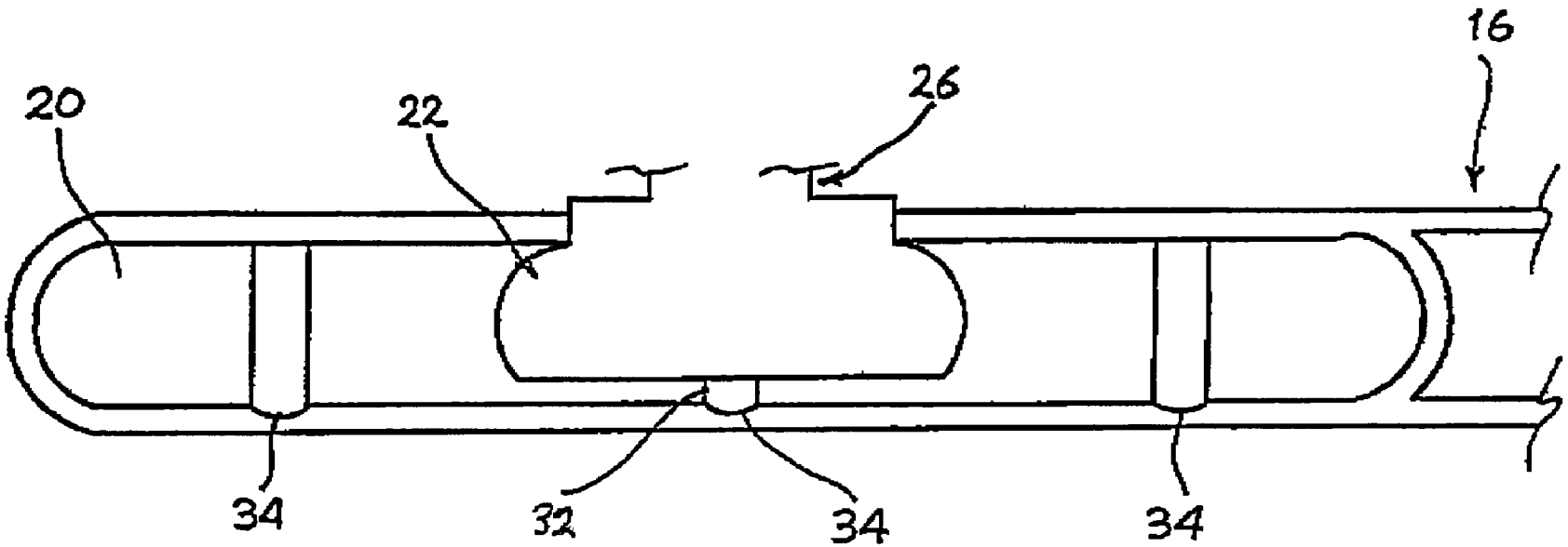
FIG. 3 is a longitudinal section view of a detail of the clothes hanger structure of FIGS. 1 and 2.

FIG. 3 illustrates a preferred embodiment of a detail of an arm 16 of the clothes hanger structure according to the invention. In it, the sliding fixing element or shuttle 22, made preferably of pliable plastic, is provided with a lower tooth 32 that constitutes a forced contact element with the lower wall of the cavity 20. Wall notches 34 are provided in such lower wall functioning as stops for the tooth 32 with respect to sliding of the shuttle 22 in the cavity of the arm. In this way it is possible to obtain a number of predefined stop positions for the shuttle 22 and therefore of the garment means of support integral with it, each of said positions corresponding for example to a garment size.

Figure 4:
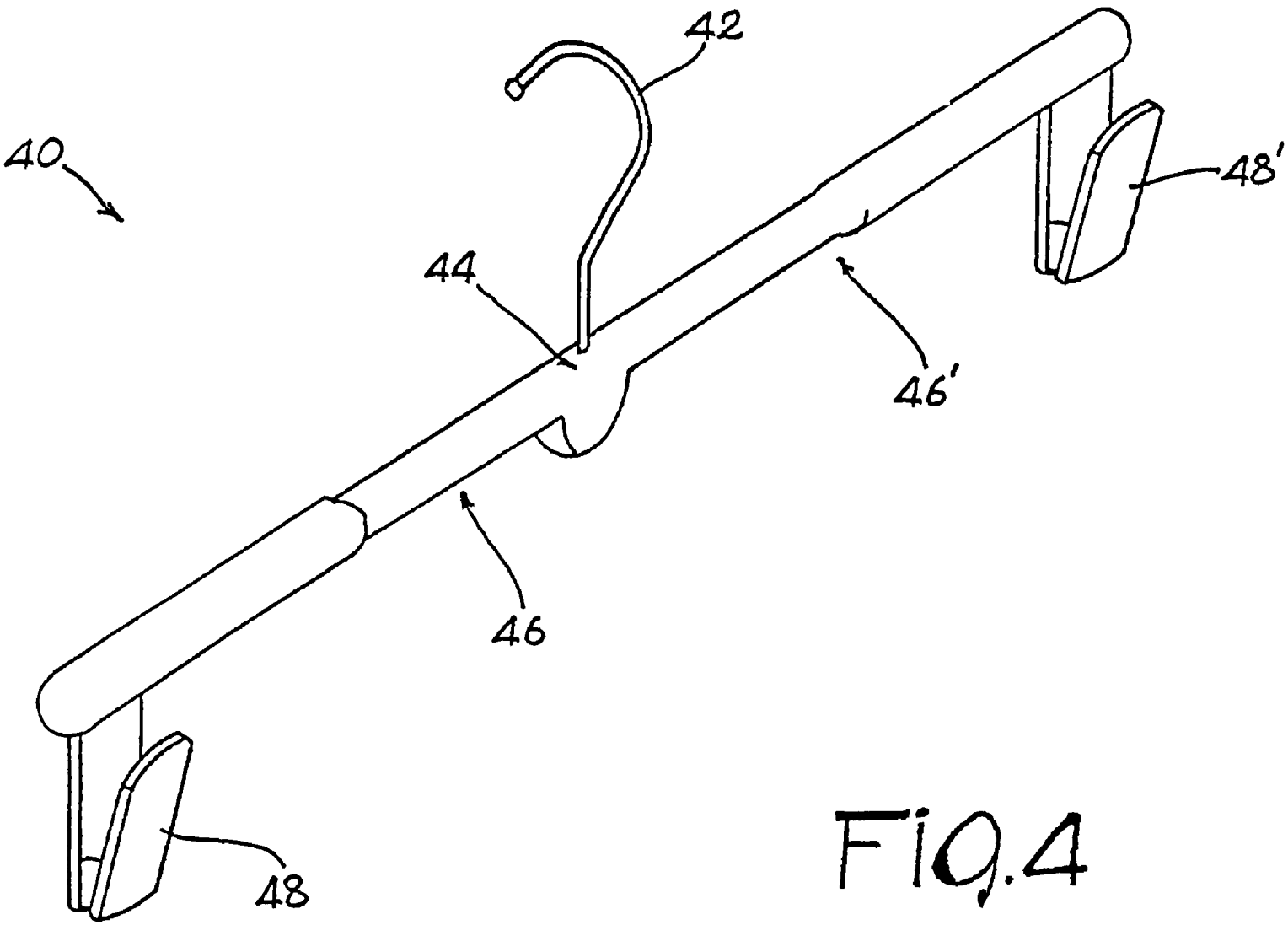
FIG. 4 is a perspective view of a clothes hanger structure according to a second embodiment of the invention.

FIG. 4 illustrates a second embodiment of the invention, typically designed for garments such as trousers or skirts. According to said embodiment, a clothes hanger structure 40 is provided with an upper hook 42 fixed to the centre point 44 of the structure. The structure also comprises two symmetrical arms 46, 46' that extend horizontally along the same axis from the centre point 44. In their distal part, each arm 46, 46' is provided with movable means of support 48, 48' of the garment which in this case consists typically of skirts or trousers. The means of support 48, 48' are substantially clips facing downwards, from which the garment is hung so that it is kept straight and without creases, thanks to gravity.

Figure 5:
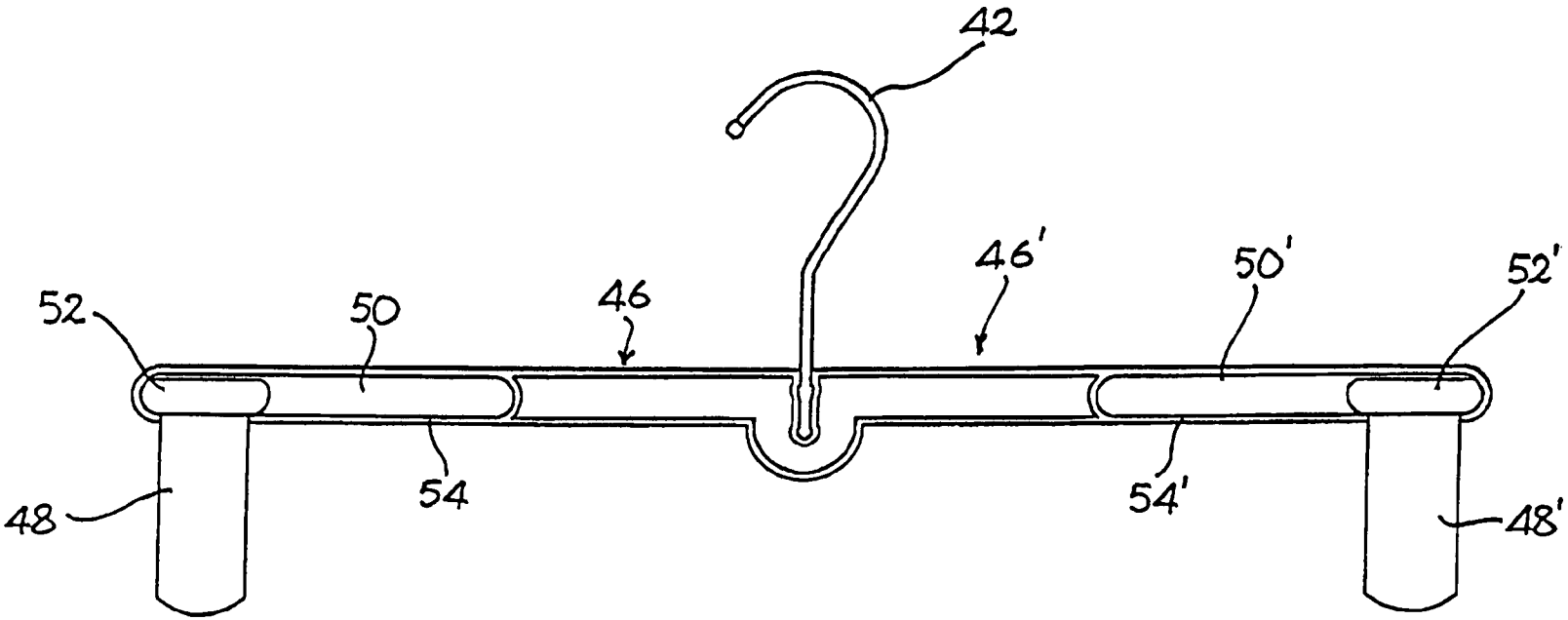
FIG. 5 is a longitudinal section view of the clothes hanger structure according to FIG. 4.

As illustrated in FIG. 5, the arms 46, 46' are provided with elongated cavities 50, 50' that extend from the ends of the arms to an approximately intermediate area of each arm. Said cavities 50, 50' constitute the seats of sliding fixing elements 52, 52' which slide like shuttles in contact with the walls of the cavities 50, 50', therefore capable of maintaining any intermediate or extreme position inside the cavities. In the lower part of the arms 46, 46' longitudinal apertures 54, 54' are provided through which clips emerge integral with the sliding elements 52, 52', which constitute the actual means of support for the garment. It is obvious that by moving the sliding elements 52, 52' in a direction parallel to the arms 46, 46', they slide in their respective cavities 50, 50' with the possibility of choosing a more or less extended position of the means of support 48, 48' of the garment, therefore adjusting the width of the clothes hanger as required.

Similarly to the illustration in FIG. 3, also in the embodiment of FIGS. 4 and 5 it is possible to provide the sliding elements 52, 52' with protruding teeth for a forced sliding movement in the cavities 50, 50' and preferential housing in corresponding notches provided in the upper part of the cavities. Said form of embodiment is not illustrated as it is conceptually identical to the ones illustrated in FIG. 3.

Figure 6:
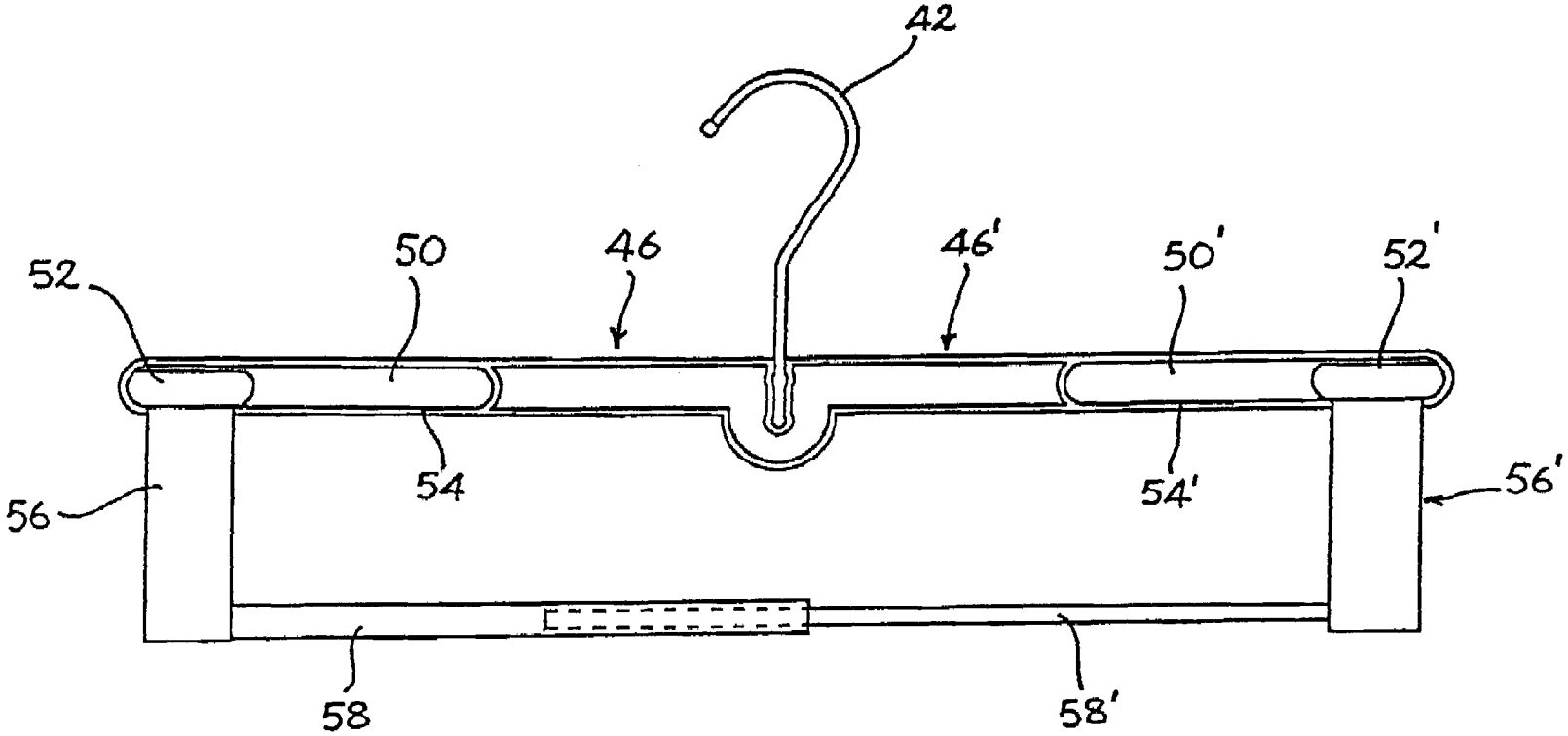
FIG. 6 is a longitudinal section view of a clothes hanger structure according to a third embodiment of the invention.

FIG. 6 illustrates a third embodiment of the invention, similar to that of FIGS. 4 and 5 as regards the structure of the arms and the sliding elements 52, 52'. A pair of connecting elements 56, 56', fixed integrally with the sliding elements 52, 52', emerges from the apertures 54, 54' of the arms and sustains the means of support which in this embodiment of the invention consist of a pair of horizontal bars 58, 58' of different diameter, inserted telescopically one inside the other. In particular, the bar 58 is fixed to the connecting element 56 and therefore runs integrally with the shuttle 52, while the bar 58' is connected integrally with the connection element 56' and runs integrally with the shuttle 52'. It is therefore possible to telescopically extend or retract the pair of bars 58, 58', adjusting the width of the garment means of support.

Both the clothes hanger structure of FIGS. 1 and 2 and that of FIGS. 4 and 5 are preferably made by constructing two equal half-shells according to the longitudinal section, as illustrated in FIGS. 2 and 5, preferably made of plastic. The sliding fixing elements 22, 22' or 52, 52' are housed in the respective cavities 20, 20' or 50, 50' in this phase, with the garment means of support emerging from the elongated holes 24, 24' or 54, 54'. The other half-shell of the structure is then assembled to its corresponding half and fixed to it, for example by slotting pins into corresponding holes provided along the inner edges of the half-shells, or by gluing, heat sealing or other appropriate fixing system. In the case of the embodiment of FIGS. 1–3, the means of support 18, 18' are then applied to the upper part of the arms (16, 16') by slotting the edge 28, 28' into the corresponding seats 30, 30' of the means of support.

Hanging means 12 and 42 are preferably of the type having a variable height, as described in copending Italian patent application no. BG2002U000014 filed on 10 Dec. 2002.

Some preferential embodiments of the invention have been described, but they can obviously be further modified and varied within the context of the inventive idea.

The invention claimed is:

1. An adjustable clothes hanger structure, comprising:

upper hanging means;

two symmetrical side arms extending from a center point of said structure;

cavities disposed inside of said side arms;

longitudinal apertures located in upper walls of said side arms;

sliding elements disposed within said cavities, said sliding elements comprising projections protruding upward through said longitudinal apertures, and movable garment supports, wherein said movable garment supports are fixed to said projections so as to permit width adjustment of said movable garment supports.

2. A clothes hanger structure according to claim 1, wherein said symmetrical side arms slant downwards and said movable means of support have a curved shape for optimal support of the garment.

3. A clothes hanger stricture according to claim 1, wherein the connection of said movable means of support to said projections of said sliding elements is provided by slotting a protruding edge of said projections into corresponding seats provided in the lower part of the means of support.

4. A clothes hanger structure according to claim 1, wherein said sliding elements are provided with at least one tooth in forced contact with a wall of the cavities in which notches are provided, wherein said notches are designed to engage said tooth to define a number of stop positions of said sliding elements.

5. A clothes hanger structure according to claim 1, wherein said upper hanging means consists of a hook fixed to the centre point of the structure.

6. A clothes hanger structure according to claim 1, wherein the clothes hanger structure is made of two symmetrical half-shells along the longitudinal axis, said half-shells being assembled after the insertion of said sliding elements in the corresponding cavities.

7. An adjustable clothes hanger structure, comprising:

upper hanging means;

two symmetrical side arms extending horizontally along a common axis from a center point of said structure;

cavities disposed inside of said side arms;

longitudinal apertures located in lower walls of said side arms;

sliding elements disposed within said cavities; and movable garment supports positioned below said side arms and connected to said sliding elements through said longitudinal apertures so as to permit width adjustment of said movable garment supports.

8. A clothes hanger structure according to claim 7, wherein said movable means of support are provided with clips for gripping the garment.

9. A clothes hanger structure according to claim 7, wherein said sliding elements are provided with at least one tooth in forced contact with a wall of the cavities in which notches are provided, wherein said notches are designed to engage said tooth to define a number of stop positions of said sliding elements.

10. A clothes hanger structure according to claim 7, wherein said movable means of support consist of a pair of bars inserted telescopically one inside the other, each fixed integrally to one of said sliding elements by means of connection elements.

* * * * *